United States Patent [19]

Stearns et al.

[11] Patent Number: 4,663,697

[45] Date of Patent: May 5, 1987

[54] FLUORESCENT LANTERN WITH REMOVABLE FLUORESCENT TUBES

[75] Inventors: David Stearns, Derby, Kans.; Leung C. Sum, Tsuen Wan, Hong Kong; Jacob Henegar, Phoenix, Ariz.

[73] Assignee: The Coleman Company, Inc., Wichita, Kans.

[21] Appl. No.: 867,201

[22] Filed: May 27, 1986

[51] Int. Cl.[4] ..... F21L 7/00

[52] U.S. Cl. ..... 362/184; 362/186; 362/225; 362/260

[58] Field of Search ..... 362/184, 185, 186, 157, 362/223, 225, 260

[56] References Cited

U.S. PATENT DOCUMENTS

| | | | |
|---|---|---|---|
| 1,927,713 | 9/1933 | Merchant | 362/185 |
| 3,767,904 | 10/1973 | Cook | 362/184 |
| 3,767,911 | 10/1973 | Oakley | 362/186 |
| 4,268,894 | 5/1981 | Bartunek et al. . | |
| 4,349,864 | 9/1982 | Smith . | |
| 4,432,043 | 2/1984 | Yuen . | |

*Primary Examiner*—Douglas Hart

[57] ABSTRACT

A fluorescent lantern supports a pair of fluorescent tubes for vertical sliding movement so that the tubes can be replaced simply by removing the cover of the lantern and withdrawing the tubes. Each of the fluorescent tubes is supported in a socket in the base of the lantern and extends upwardly through an opening in the top of the lantern. The cover is removably attached to the top by tabs so that the cover can be removed by rotating and lifting the cover. When the cover is removed, the fluorescent tubes can be withdrawn upwardly through the openings in the top. The base includes a battery compartment for a battery power source, and the battery compartment is closed by a battery cover which is removably attached to the base by tabs so that the cover can be removed by rotating and withdrawing the cover.

15 Claims, 7 Drawing Figures

FIG. 1
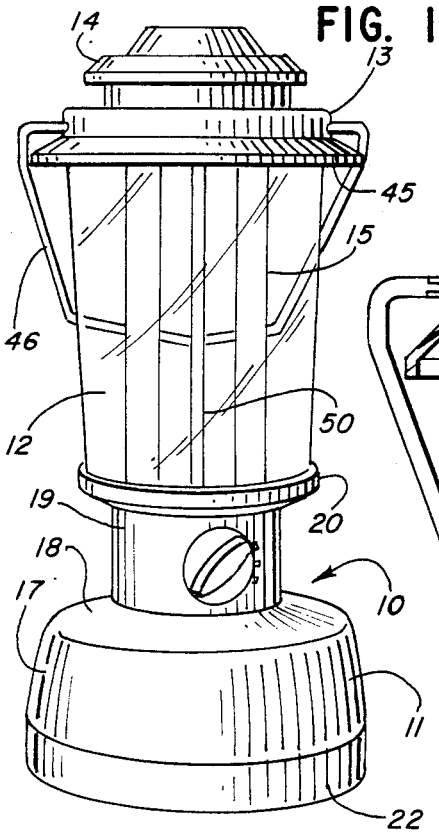
FIG. 2
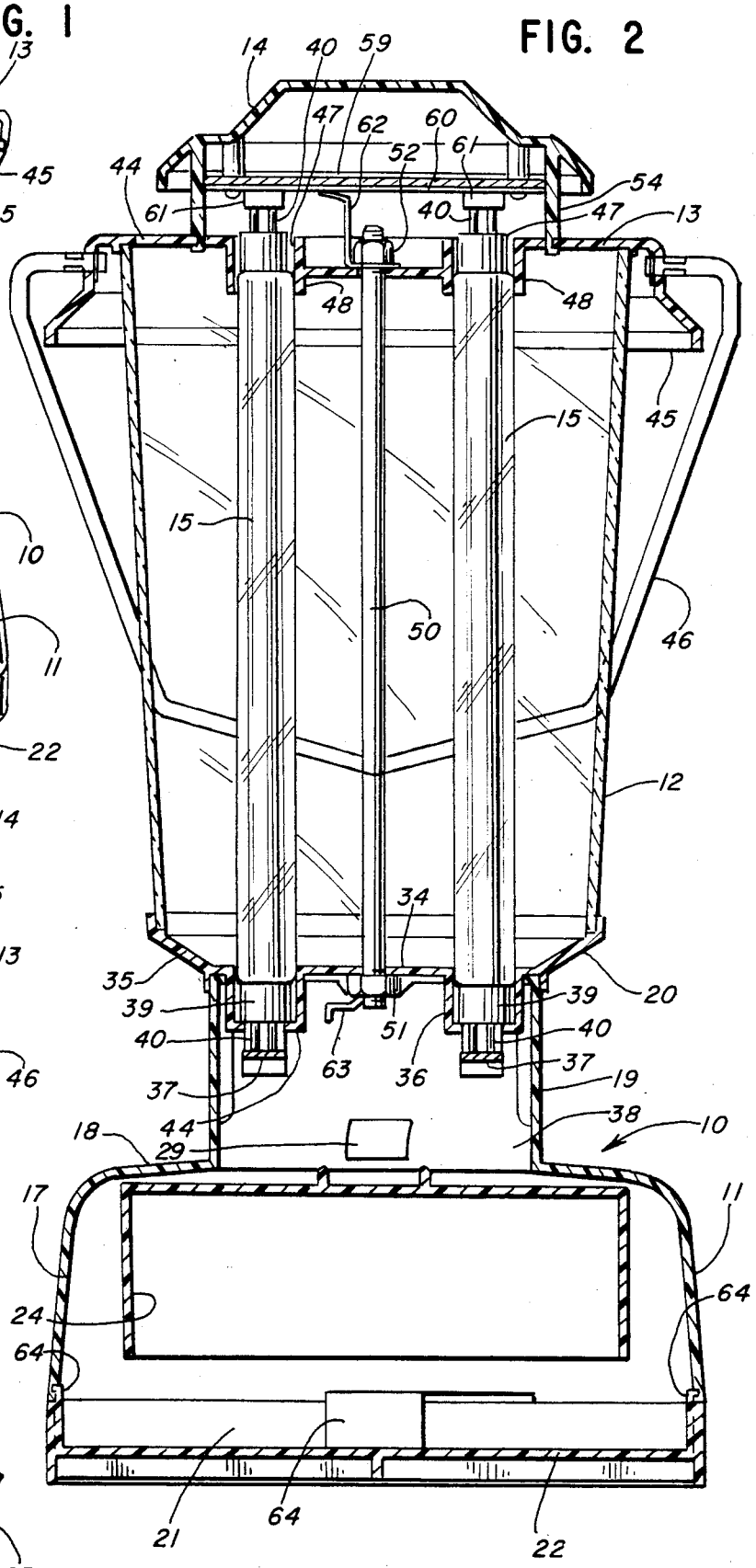
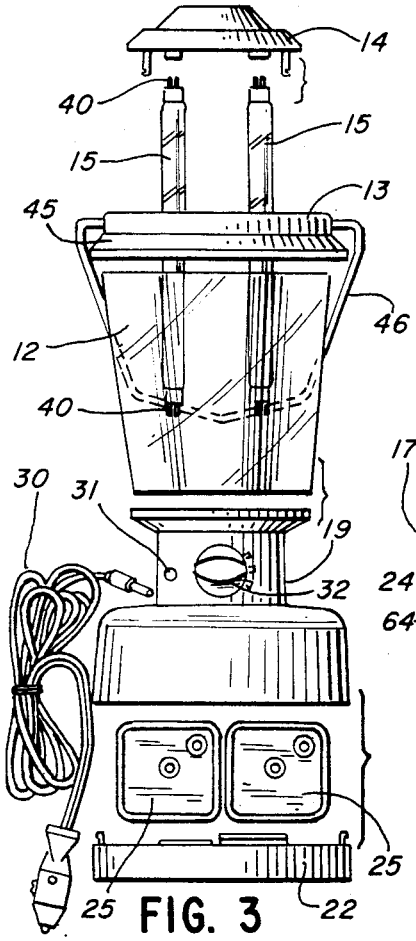
FIG. 3

FIG. 4
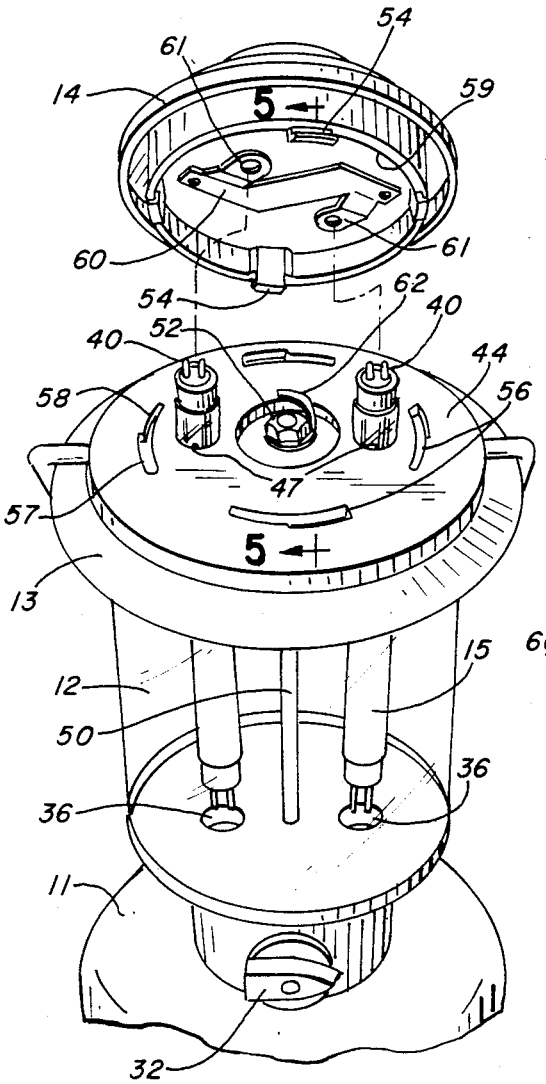
FIG. 6
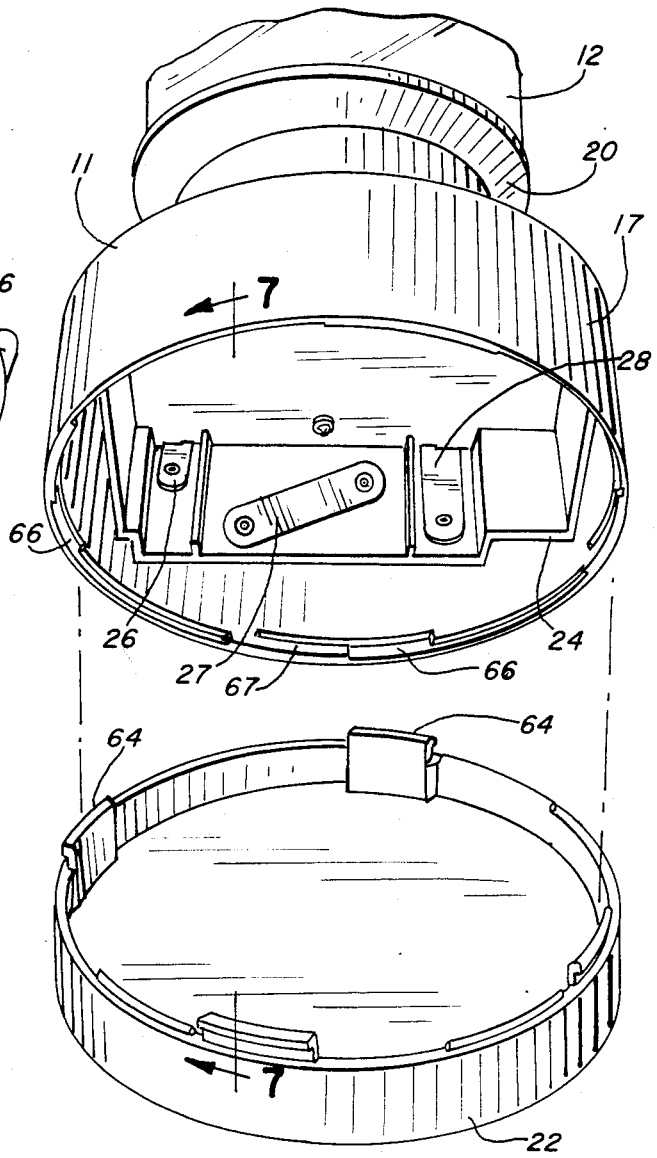
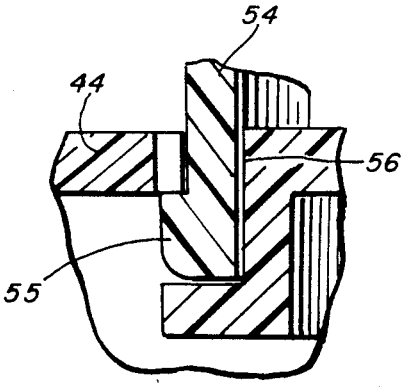
FIG. 5
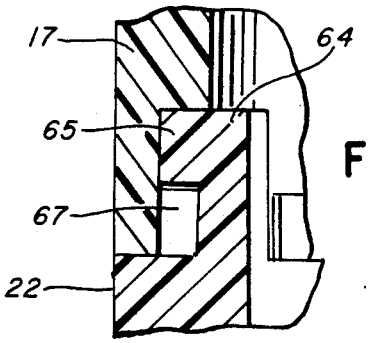
FIG. 7

FLUORESCENT LANTERN WITH REMOVABLE FLUORESCENT TUBES

BACKGROUND AND SUMMARY

This invention relates to a fluorescent lantern, and, more particularly, to a fluorescent lantern in which the fluorescent tubes can be removed merely by rotating and lifting the cover of the lantern and withdrawing the fluorescent tubes.

Fluorescent lanterns generally include a base, a globe supported by the base, and a top supported by the globe. One or more fluorescent tubes are supported by the base and the top, and light emitted by the fluorescent tubes shines through the globe.

The fluorescent tubes must be replaced form time to time because the tubes burn out or break. Heretofore, replacement of the fluorescent tubes generally required removal of one or more screws or other fastening means before the fluorescent tubes could be removed and replaced. After the fluorescent tubes were replaced, the screws had to be resecured.

The invention permits the fluorescent tubes to be removed simply by rotating and removing a cover which is removably attached to the top of the lantern and then withdrawing the tubes upwardly from the top. The fluorescent tubes are slidably supported in sockets in the base of the lantern and in openings in the top of the lantern. Flexible and resilient tabs or a metal plate in the cover make electrical contact with the fluorescent tubes when the cover is attached to the top, and the metal plate is connected to a power source in the base by a rod which extends between the top and the base and which clamps the top, the globe, and the base together. The base includes a battery compartment for an electric battery, and the battery compartment is closed by a cover which is removably attached to the base. The battery can be replaced simply by rotating and removing the cover from the base.

DESCRIPTION OF THE DRAWING

The invention will be explained in conjunction with an illustrative embodiment shown in the accompanying drawing, in which—

FIG. 1 is a perspective view of a fluorescent lantern formed in accordance with the invention;

FIG. 2 is an enlarged sectional view of the lantern;

FIG. 3 is an exploded elevational view of the lantern;

FIG. 4 is a fragmentary exploded top perspective view of the lantern;

FIG. 5 is an enlarged fragmentary sectional view showing the attachment of the cover to the top;

FIG. 6 is a fragmentary exploded bottom perspective view of the battery compartment in the base of the lantern; and FIG. 7 is an enlarged fragmentary sectional view showing the attachment of the battery cover to the base.

DESCRIPTION OF SPECIFIC EMBODIMENT

The numeral 10 designates generally a fluorescent lantern which includes a base 11, a transparent globe 12, a top 13, and a cover 14. A pair of fluorescent tubes 15 extend between the base and the top through the globe so that light from the fluorescent tubes can shine through the globe.

The base 11 includes a generally cylindrical bottom wall 17 which merges with a generally dome-shaped wall 18, a cylindrical collar 19, and an upper wall 20 which supports the wall 12. The bottom wall 17 provides a battery compartment 21, and the battery compartment is closed by a cover 22 which is removably attached to the bottom wall 17.

An open-bottomed battery container 24 (FIG. 2) is mounted within the battery compartment and is sized to receive a pair of conventional 6 volt dry cell batteries 25 (FIG. 3). Metal contacts 26, 27, and 28 (FIG. 6) are secured to the battery container for connecting the batteries in series to a conventional ballast 29 (FIG. 2) which is mounted above the battery container inside the collar 19. An alternative source of power can be provided by an automobile battery which may be connected to the lantern by a cord 30 (FIG. 3). The cord can be plugged into a socket 31 in the collar. A control knob 32 mounted on the collar 19 opens and closes the electrical circuit between the power source and the ballast.

The top wall 20 of the base includes a horizontal central portion 34 and a frusto-conical rim 35 which supports the globe 12. A pair of cylindrical sockets 36 project downwardly into the central portion 34. The bottoms of the sockets are open, and a flexible and resilient metal electrical contact plate 37 is mounted below each socket and is electrically connected to one of the poles of the power supply. Each of the contact plates 37 is attached to a vertical support plate 38, which also supports the ballast 29.

The lower end of each of the fluorescent tubes 15 is supported in one of the sockets. The fluorescent tubes are conventional, and each end of the tube includes an end cap 39 and a pair of contact pins 40 which project from the end cap. The contact pins 40 engage the flexible contact plate 37, and downward movement of the end cap 39 is limited by an annular shoulder 41 in the socket 36.

The top 13 includes a horizontal central portion 44 and a depending rim 45. A bail or handle 46 is connected to the rim 45. A pair of openings 47 are provided in the central portion 44, and each opening is surrounded by a cylindrical collar 48. The upper end of each of the fluorescent tubes is slidably supported within one of the collars 48.

The base 11, globe 12, and top 13 are clamped together by a metal rod 50 which extends through openings in the base and the top. The lower end of the rod 50 is secured by a nut 51, and the upper end of the rod is secured by a nut 52.

The cover 14 is generally cup-shaped and includes four downwardly extending attaching tabs 54. Each attaching tab includes an outwardly extending flange 55 (FIG. 5), and each tab is inserted into a curved slot 56 (FIGS. 4 and 5) in the horizontal portion 44 of the top 13. Each slot includes a wide portion 57 through which the flange 55 can be inserted and a narrow portion 58 which retains the flange. The cover is locked by inserting the tabs through the wide portions 57 of the slots and then rotating the cover clockwise.

A bottom plate 59 (FIG. 4) is attached to the inside of the cover, and a metal plate 60 is attached to the bottom plate. The metal plate includes a pair of flexible and resilient contact tabs 61 which extend downwardly from the central portion of the plate. The contact tabs 61 engage the upper pins 40 of the fluorescent tubes when the cover is attached to the top.

A flexible and resilient metal contact tab 62 (FIGS. 2 and 4) is inserted over the upper end of the metal rod 50 and is secured by the nut 52. The tab 62 engages the metal plate 60 when the cover is attached, and the upper pins of the fluorescent tubes are connected to the other pole of the power source through the metal plate 60, contact tab 62, metal rod 50, and wire 63 (FIG. 2) which is attached to the lower end of the rod 50.

The cover 22 for the base 11 is removably attached to the base by four attaching tabs 64 (FIGS. 6 and 7). Each attaching tab includes an outwardly extending flange 65. The bottom edge of the base 11 is provided with four L-shaped recesses 66 on the inside surface of the base, and a retaining flange 67 extends inwardly below about one-half of each recess. The cover is attached by inserting the tabs 64 into the recesses and rotating the cover clockwise to rotate the flanges 65 on the tabs into locking engagement with the flanges 67 on the base.

The fluorescent tubes are inserted into the lantern merely by rotating and removing the cover and then inserting the tubes through the openings 47 in the top and into the sockets 36 in the base. The cover is then replaced on the top. As the cover is rotated into a slot position, the electrical contact tabs 61 move into engagement with the upper pins of the fluorescent tubes. The upper and lower pins of the fluorescent tubes are thereby automatically connected to the electrical circuit of the lantern when the cover is secured. The fluorescent tubes can be removed by following the reverse procedure.

While in the foregoing specification a detailed description of a specific embodiment of the invention has been set forth for the purpose of illustration, it will be understood that many of the details herein given may be varied considerably by those skilled in the art without departing from the spirit and scope of the invention.

We claim:

1. A fluorescent lantern comprising:

a base for supporting the lantern, a globe above the base, a top above the globe, a cover removably attached to the top, a fluorescent tube extending through the globe between the base and the top, the fluorescent tube having a lower end supported by the base and an upper end which extends through an opening in the top, electrical contact means in the base for connecting an electric circuit to the lower end of the fluorescent tube, electrical contact means in the cover for connecting an electric circuit to the upper end of the fluorescent tube, the fluorescent tube being slidably mounted within the opening in the top whereby the fluorescent tube can be removed from the lantern by removing the cover from the top and withdrawing the fluorescent tube upwardly through the opening in the top.

2. The lantern of claim 1 in which the cover includes a plurality of locking tabs which are releasably secured within slots in the top whereby the cover can be removed by rotating and lifting the cover with respect to the top.

3. The lantern of claim 1 in which the electrical connecting means in the cover includes a metal plate mounted on the cover and a contact portion flexibly and resiliently connected to the plate and extending downwardly therefrom.

4. The lantern of claim 1 including a rod extending between the top and the base and connecting the electrical contact means in the top with the source of electric power.

5. The lantern of claim 4 in which the rod is secured to the base and is threadedly engaged with a nut which clamps the top against the globe and the globe against the base.

6. The lantern of claim 4 including a flexible and resilient metal contact which is attached to the rod and engages the electrical contact means in the cover.

7. The lantern of claim 1 in which the base is provided with a battery compartment for holding an electric battery, the lantern including a pair of battery contacts mounted on the battery compartment and electrical connecting means for connecting the electrical contact means in the base and in the cover to the battery contacts.

8. The lantern of claim 7 including a battery compartment cover which has a plurality of locking tabs which are releasably secured within recesses in the base whereby the battery compartment cover can be removed by rotating and withdrawing the cover with respect to the base.

9. A fluorescent lantern comprising:

a base for supporting the lantern, the base having a lower surface for supporting the base on a support surface and an upper surface and a pair of sockets in the upper surface, a globe supported by the upper surface of the base, a top above the globe and supported thereby, the top having a pair of openings vertically aligned with the sockets and the base, a pair of fluorescent tubes, each of the tubes having a lower end which is supported in one of the sockets in the base and an upper end which extends upwardly through one of the openings in the top, the fluorescent tubes being supported by the sockets and the openings for upward vertical sliding movement, a cover removably attached to the top, electrical contact means in the base for connecting an electric circuit to the lower end of the fluorescent tubes, and electrical contact means in the cover for connecting an electric circuit to the upper end of the fluorescent tubes.

10. The lantern of claim 9 in which the cover includes a plurality of locking tabs which are releasably secured within slots in the top whereby the cover can be removed by rotating and lifting the cover with respect to the top.

11. The lantern of claim 9 in which the electrical contact means in the cover includes a metal plate mounted on the cover and a pair of contact portions flexibly and resiliently connected to the plate and extending downwardly therefrom into engagement with the fluorescent tubes.

12. The lantern of claim 9 including a rod extending between the top and the base and connecting the electrical contact means in the top with the source of electric power, the rod being secured to the base and being threadedly engaged with a nut which clamps the top against the globe and the globe against the base.

13. The lantern of claim 12 including a flexible and resilient metal contact which is attached to the rod and engages the electrical contact means in the cover.

14. The lantern of claim 9 in which the base is provided with a battery compartment for holding an electric battery, the lantern including a pair of battery contacts mounted on the battery compartment and electrical connecting means for connecting the electrical contact means in the base and in the cover to the battery contacts.

15. The lantern of claim 14 including a battery compartment cover which has a plurality of locking tabs which are releasably secured within recesses in the base whereby the battery compartment cover can be removed by rotating and withdrawing the cover with respect to the base.

* * * * *